United States Patent [19]

Michal

[11] 4,058,356

[45] Nov. 15, 1977

[54] JEWELRY BOX

[76] Inventor: Dorothy Hamilton Michal, 14544 Cleveland Ave., Posen, Ill. 60469

[21] Appl. No.: 683,698

[22] Filed: May 6, 1976

[51] Int. Cl.[2] ..... A47B 88/00; A47B 57/00; B65G 11/04

[52] U.S. Cl. ..... 312/305; 312/324; 211/163; 232/55

[58] Field of Search ..... 312/252, 283, 285, 305, 312/125, 135; 232/55; 211/163, 58

[56] References Cited

U.S. PATENT DOCUMENTS

| | | | |
|---|---|---|---|
| 346,295 | 7/1886 | Levenguth | 312/305 |
| 351,911 | 11/1886 | Greer | 232/58 |
| 452,594 | 5/1891 | Charles | 312/324 |
| 1,882,345 | 10/1932 | Upham | 312/125 |
| 2,564,949 | 8/1951 | Bell | 312/324 |
| 2,680,665 | 6/1954 | Gillespie | 312/305 |
| 3,194,621 | 7/1965 | Frost | 312/324 |
| 3,197,096 | 7/1965 | Marcocchio | 312/305 |
| 3,822,659 | 7/1974 | Maag | 312/324 |
| 3,860,307 | 1/1975 | Fostel | 312/324 |
| 3,880,484 | 4/1975 | Sicina | 312/125 |

*Primary Examiner*—Paul R. Gilliam
*Assistant Examiner*—Victor N. Sakran
*Attorney, Agent, or Firm*—Sabin C. Bronson

[57] ABSTRACT

A jewelry box is provided for all kinds of jewelry, costume or otherwise, precious gems, etc., whereby all kinds may be kept in one place, segregated, easy of access, and occupying little space. It is of upright rectangular form slightly tapered, with two sides hinged forming doors with hooks on the inside to hold bracelets or watches for example, also rings or earrings. A short distance upward from the bottom of the box is a shelf, and axially between the shelf and the top is a rotatable hollow tube with an inside diameter about 11/16 inch so that a dime may be placed through a slot in the top and fall down into the tube. On this center tube are short fingers projecting radially therefrom to hold chains, watches or the like. Between the shelf and the bottom of the box is a transparent removable box in which overflow articles may be kept.

1 Claim, 4 Drawing Figures

FIG. 1
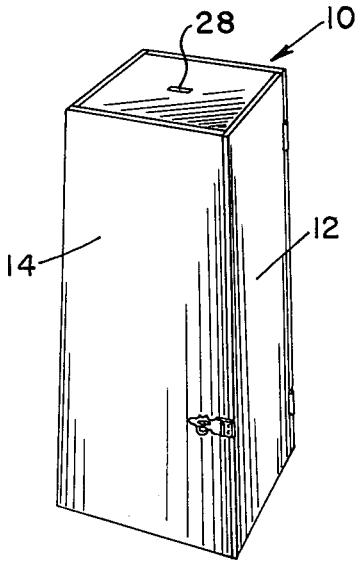
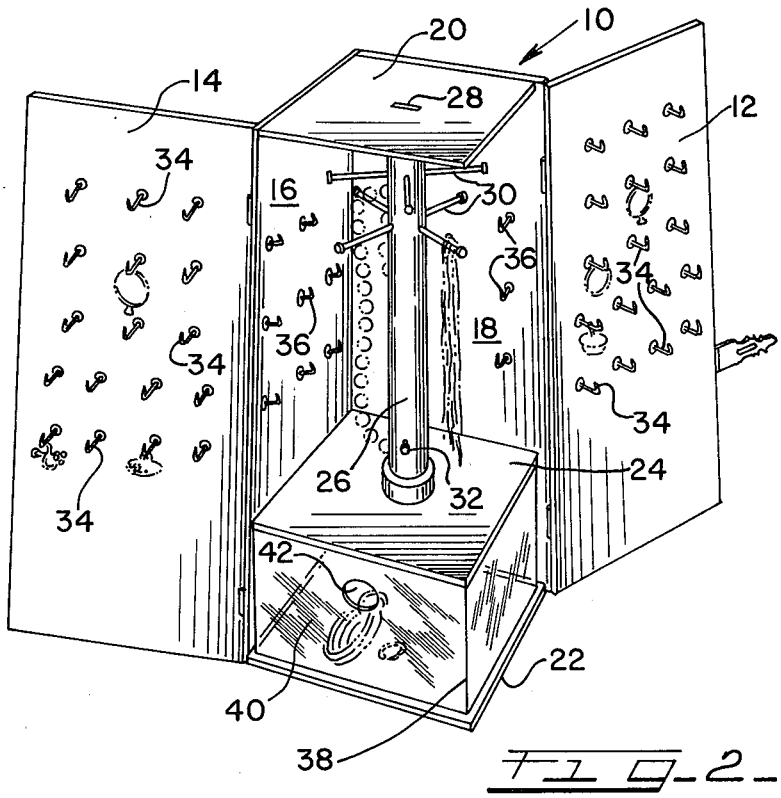
FIG. 2
FIG. 3
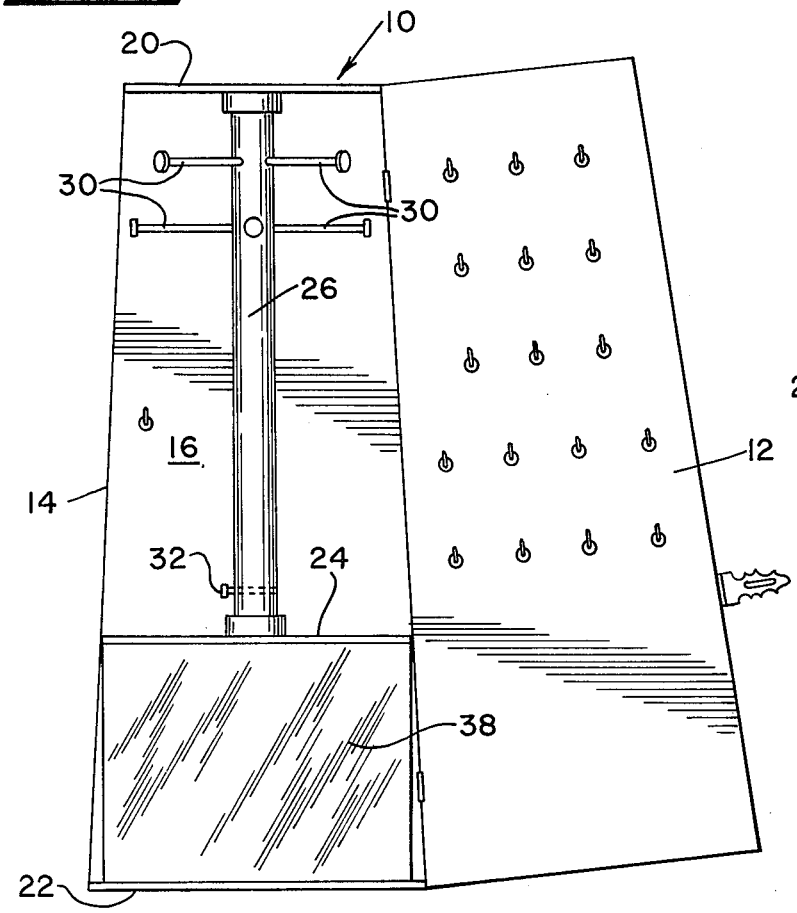
FIG. 4
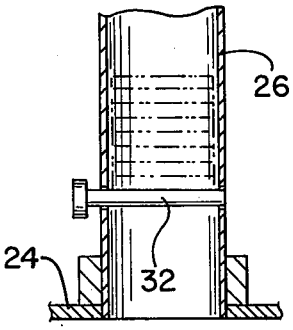

JEWELRY BOX

BACKGROUND AND SUMMARY OF THE INVENTION

Every woman possesses a myriad of jewelry of every type, precious, costume, or otherwise, usually kept in small boxes in the top drawer of her dresser, but, when that drawer is opened, relatively few pieces are instantly visible and the process begins of looking in this box or that for the particular item she wants to complement her dress for the evening, usually amid calls of "hurry up or we'll be late."

Applicant has provided a jewelry box whereby when the doors of same are opened everything milady possesses in the way of jewelry is instantly visible and easily accessible. No delays in looking for the article desired.

BRIEF DESCRIPTION OF THE DRAWINGS

In the drawings, accompanying and forming part of this application, and wherein like reference characters indicate like parts:

FIG. 1 is a perspective view of the jewel box in closed position.

FIG. 2 is a perspective view of the box with two sides of the box, forming hinged doors, open.

FIG. 3 is a front elevation of the box, with one of the doors open.

FIG. 4 is a vertical cross section of the lower part of the central tube.

DESCRIPTION OF THE PREFERRED EMBODIMENT

In the drawings 10 indicates generally an upright rectangularly shaped container, somewhat tapered, and with two of the side walls 12 and 14 hinged thereto. The other two sides 16 and 18 are secured at their upper ends to the top 20, at their lower ends to the bottom 22, and a shelf 24, is secured above the bottom to the sides 16 and 18 to form a rigid support structure for the hinged sides 12 and 14 forming the doors for the box.

Axially disposed between the centers of the top 20 and shelf 24 of the box, and rotatably installed therebetween is a hollow tubular member 26. Through the top of the box, and registering with the inner diameter of said tube is a slot 28 through which a dime may be placed. Thus the tube doubles in function as a dime bank. Radially extending in random fashion from the periphery of this tube 26 are a plurality of nail like fingers 30 on which may be suspended chains, necklaces, chockers, beads, and the like, as indicated in FIG. 2. Near the bottom of this tube is installed, horizontally thereacross, a pin 32 to form a stop for any dimes placed through the slot 28. This pin is removable to release the dimes held thereupon so that they may fall down through the tube and shelf 24 into the space therebelow and onto the bottom 22 of the box, thereby emptying the bank.

As indicated in FIGS. 2 and 3 the inner faces of the doors 12 and 14 are provided with a plurality of relatively short hooks 34 on which may be hung rings or earrings, and on the other two sides 16 and 18 are a plurality of hooks 36 to hold bracelets or watches.

The box itself is constructed of a good grade of plywood or the like, and finished in any color desired to match mahogany, walnut, or other furniture.

In the space between the shelf 24 and the bottom 22 of the box I have provided a removable plexiglass transparent container indicated at 38 which is simply slid into place between the shelf and bottom 22. This container is for overflow items which cannot be conveniently hung in the box above the shelf 24 such as charm bracelets or necklaces with large onyx pieces suspended therefrom etc. The container in one of its exposed sides 40 when the doors are open is provided with a finger hole 42 so that this box may be easily grasped and withdrawn from the box when desired.

From the above description it is believed the invention has been described with the requisite particularity so that one versed in the art may make and use the same.

I claim:

1. A jewelry box comprising a vertically, elongated, rectangular box having sides, top and bottom, two of said sides being fixedly disposed between said top and bottom, the remaining two sides being hingedly mounted to the said first two sides to provide easy access to the interior of said sides, means on the inside of all of said sides for hanging various types of jewelry thereon, a shelf fixed to two said fixed sides a short distance above the bottom thereof forming a compartment between the shelf and the bottom, a transparent removable container positioned in and being of the same substantial size as a single vertically disposed tube positioned between said shelf and said top, means mounting said tube for rotation, fingers extending radially from said tube to hold jewelry, said top being provided with a slot over said tube so that coins may be dropped through said slot into said tube, and a pin removably installed transversely through said tube to provide a stop for coins deposited in said tube.

* * * * *